US006715172B2

(12) United States Patent
Leventhal et al.

(10) Patent No.: US 6,715,172 B2
(45) Date of Patent: Apr. 6, 2004

(54) SYSTEM FOR CONTROLLING THE POSITION OF AN INFLATABLE BEDREST POSITIONED UNDER A MATTRESS

(75) Inventors: Robert Leventhal, Los Angeles, CA (US); Paul Thomas, San Pedro, CA (US)

(73) Assignee: Banyan Licensing LC, Ft. Lauderdale, FL (US)

( * ) Notice: Subject to any disclaimer, the term of this patent is extended or adjusted under 35 U.S.C. 154(b) by 0 days.

(21) Appl. No.: 10/316,551

(22) Filed: Dec. 11, 2002

(65) Prior Publication Data

US 2003/0188387 A1 Oct. 9, 2003

Related U.S. Application Data

(63) Continuation-in-part of application No. 10/116,230, filed on Apr. 4, 2002.

(51) Int. Cl.[7] ..... A47C 31/00
(52) U.S. Cl. ..... 5/660; 5/659; 5/713
(58) Field of Search ..... 5/660, 659, 713

(56) References Cited

U.S. PATENT DOCUMENTS

| | | | |
|---|---|---|---|
| 3,392,412 | A | 7/1968 | Aymar |
| 3,426,373 | A | 2/1969 | Scott et al. |
| 3,606,623 | A | 9/1971 | Aymar |
| 3,667,075 | A | 6/1972 | Dallard et al. |
| 3,781,928 | A | 1/1974 | Swallert |
| 4,309,783 | A | 1/1982 | Cammack et al. |
| 4,527,298 | A | 7/1985 | Moulton |
| 4,686,722 | A | 8/1987 | Swart |
| 4,839,932 | A | 6/1989 | Williamson |
| 5,170,522 | A | 12/1992 | Walker |
| 5,267,363 | A | 12/1993 | Chaffee |
| 5,577,278 | A | 11/1996 | Barker et al. |
| 6,012,186 | A | 1/2000 | Soltani et al. |
| 6,311,348 | B1 | 11/2001 | Luff et al. |
| 2001/0047549 | A1 | 12/2001 | Ulert et al. |

FOREIGN PATENT DOCUMENTS

| | | |
|---|---|---|
| EP | 0 630 635 A2 | 12/1994 |
| FR | 2 660 190 | 10/1991 |

*Primary Examiner*—Teri Pham Luu
(74) *Attorney, Agent, or Firm*—Alston & Bird LLP

(57) ABSTRACT

There is provided a bedrest including an inflatable bladder, a compressor assembly and a microprocessor based controller for inflating and deflating the bladder. The compressor assembly has several stages reducing the volume of air. The compressor assembly includes a housing having an air intake, a motor and a centrifugal blower for passing air into a valve assembly. When inflating, the air passes under pressure through the centrifugal blower, past the motor and through a check valve into the valve assembly and through air outlet that is connected to an air supply tube. In a preferred embodiment, the valve assembly is equipped with a solenoid relief valve for use when deflating the bladder. The microprocessor based controller enables an individual to inflate or deflate the bladder to any desired amount with a simple control. In addition, the hand controlled microprocessor permits computer programming so that the mattress can be automatically raised and lowered to different levels during different periods of time. An additional feature is that one does not need to simply continue to hold the switch down in order to raise or lower the bladder portion but instead can press a simple button after the entire hand controlled microprocessor has been preprogrammed so that any one of a number of different adjustments can be made and these can be made at any given time and preset to any given time and interval.

22 Claims, 10 Drawing Sheets

SYSTEM FOR CONTROLLING THE POSITION OF AN INFLATABLE BEDREST POSITIONED UNDER A MATTRESS

CROSS-REFERENCE TO RELATED APPLICATION

This application is a continuation-in-part of copending U.S. patent application Ser. No. 10/116,230 filed on Apr. 4, 2002, which is hereby incorporated herein in its entirety by reference.

BACKGROUND OF THE INVENTION

1. Field of the Invention

The present invention relates to a system for controlling the position of an inflatable bedrest placed under a mattress. More particularly, the invention relates to a system for controlling an inflatable bladder for use in raising and lowering a portion of a mattress at the head and/or feet of a user.

2. Description of Related Art

Adjustable beds have found widespread use beyond non-ambulatory patients and are used in many homes among persons of all age groups, in particular beds that raise the head and/or feet. Among the devices used to raise the head or feet are inflatable air bladders intended for use with conventional beds. A number of patents disclose bladders for this purpose. For example, U.S. Pat. No. 3,392,412 to Aymar provides an inflatable bedrest placed under a mattress. The bedrest is in the form of a bellows filled with compressed air by a conventional electric motor having a casing mounted on legs with the bottom of the casing having an opening for the admission of air. Inside the casing there is an electric air compressor with a rotor having a shaft with blades. The air is compressed within the casing and passes through a valve located in the casing and then into a tube carrying the compressed air to the bellows. The user, lying on the bed, operates a switch to turn the motor on and off to inflate the bellows. The process may be reversed to deflate the bellows so that the compressed air will flow out through the casing.

Another adjustable bedrest is shown in U.S. Pat. No. 3,667,075 which discloses a bellows assembly placed under a mattress whereby the mattress is raised either at the head section or under the knees to different heights through the expandable bellows. The bellows assembly is activated by a motor containing position switches that are manually turned upwardly to actuate respective spool valves. When turned downwardly, the switches operate respective solenoid valves.

The Cammack patent, U.S. Pat. No. 4,309,783, discloses an inflatable bladder for raising or lowering different portions of a bed. The bladder includes flexible elements which extend from adjacent the apex to adjacent a sidewall designed to limit the expansion of the bladder. The bladder is coupled to a pump by an air hose. The pump is connected to a conventional electric outlet and by another cord to a control mechanism. The pump includes an overall housing that has a circumferential vent for communication with the external atmosphere. An annular air filter is disposed immediately inside the vent. Supported within the housing is an electric motor that drives a centrifugal blower. When activated, the blower draws air through the vent developing a positive pressure within the housing. The control mechanism has two double acting rocker buttons associated respectively with the valve outlets. Upon depression of a rocker button in one direction, the pump is energized at the same time that the valve outlet is opened allowing air to be delivered to the bladder. The same rocker button moved in the opposite direction enables air to be removed from the bladder.

U.S. Pat. No. 5,170,522 to Walker discloses an air adjustable bed having a foundation that has a first open top housing or recess located below a first transverse backrest plate. A first lift air bag is located in a first recess. When expanded, the first air bag has a generally triangular configuration to elevate the transverse backrest plate in a generally upward inclined position. A second air lift bag is located adjacent the leg portion of the structure in a second recess located below a second transverse backrest plate. When expanded, the second bag has a generally trapezoidal configuration. An air mattress is located on top of the foundation and the air mattress is adapted to bend with the transverse plates when the plates are elevated with the first and second lift air bags. A controller is used to control the operation of a pump to change the air pressure in the air bags. The controller has air operated switches for regulating a pump to supply air to air mattresses and lift air bags. Switches also control separate solenoid valves that are used to direct to the air mattress and lift bags.

U.S. Pat. No. 5,267,363 to Chaffee discloses a portable inflatable support system for inflating a mattress and in particular a dual valve assembly. The inflator is either battery powered or line-powered and is removably engaged with a pressure valve positioned in the mattress. In one embodiment, the inflator includes a dc motor powered by rechargeable batteries and an impeller driven by the motor, all mounted in a housing having a mouth region that is removably engaged with the inflation input of the dual valve. The inflator is connected directly to the mattress. The inflator is designed to cease delivering air to the mattress after a determined time has elapsed.

It is an object of the present invention to provide a compact, easy to use system for inflating a bladder used to lift a portion of a bed mattress that provides the necessary combination of pressure and volume of air to easily inflate the bladder.

Another object of the present invention is to provide a hand held controller with a microprocessor for controlling the inflation and deflation cycles of an inflatable bedrest.

A still further object is to provide an efficient multi-stage compressor assembly capable of providing the air pressure and volume needed to fill the bladder in a short period of time.

It is a further object of the present invention to provide a compressor that is capable of inflating a bedrest bladder and yet be sized so as to fit under the bed.

SUMMARY OF THE INVENTION

The above and other objects and advantages of the invention are achieved by the provision of a system including a novel inflatable bladder, a microprocessor based hand held controller for controlling inflation and deflation of the bladder and an improved multi-stage compressor assembly for supplying compressed air to the bladder. The system may be used with a conventional bed.

The bladder contains an interior baffle which is essentially is two sheets of material which extend for primarily the length of the bladder and are welded to interior walls of the bladder to form an inverse triangle inverse to the triangle formation of the bladder once it is inflated. The benefit of this interior baffle is that once the bladder is inflated, the baffle will cause the bladder to form into an appropriate triangular shape. Without this baffle, even though the overall structure of the bladder is intended to be triangular when it is inflated, the shape cannot be as precisely controlled without the baffle and the resultant bladder will form into possibly a circle or an oblong shaped object of non-triangular shape. The interior baffle wall therefore enables the structure to form more precisely into the desired triangular shape in order to perform a more effective position when inserted under the mattress in the head location of the bed.

The compressor assembly has several stages reducing the volume of air. The compressor assembly includes a housing having an air intake, a motor and a centrifugal blower for passing air into a valve assembly. The compressor assembly also includes controls for directing the motor and the valve assembly. When inflating, the air passes under pressure through the centrifugal blower, past the motor and through a check valve into the valve assembly and through air outlet that is connected to an air supply tube. In a preferred embodiment, the valve assembly is equipped with a solenoid operated relief valve for use when deflating the bladder.

The microprocessor based controller enables an individual to inflate or deflate either the bladder under the head area or the bladder under the knee area of the bed to any desired amount with a simple control. In addition, the microprocessor permits computer programming so that the portions of the mattress can be automatically raised and lowered to different levels during different periods of time. An additional feature is that one does not need to simply continue to hold the switch down to raise or lower the bladder but instead can press a simple button after the microprocessor has been preprogrammed so that any one of a number of different adjustments can be made and these can be made at any given time and preset to any given time and interval.

Thus, with the present invention there is provided a system for raising and lowering the head and or leg area of a bed that is easy to install, simple in operation and one that may be used with a conventional bed.

BRIEF DESCRIPTION OF THE DRAWINGS

Figure 1:
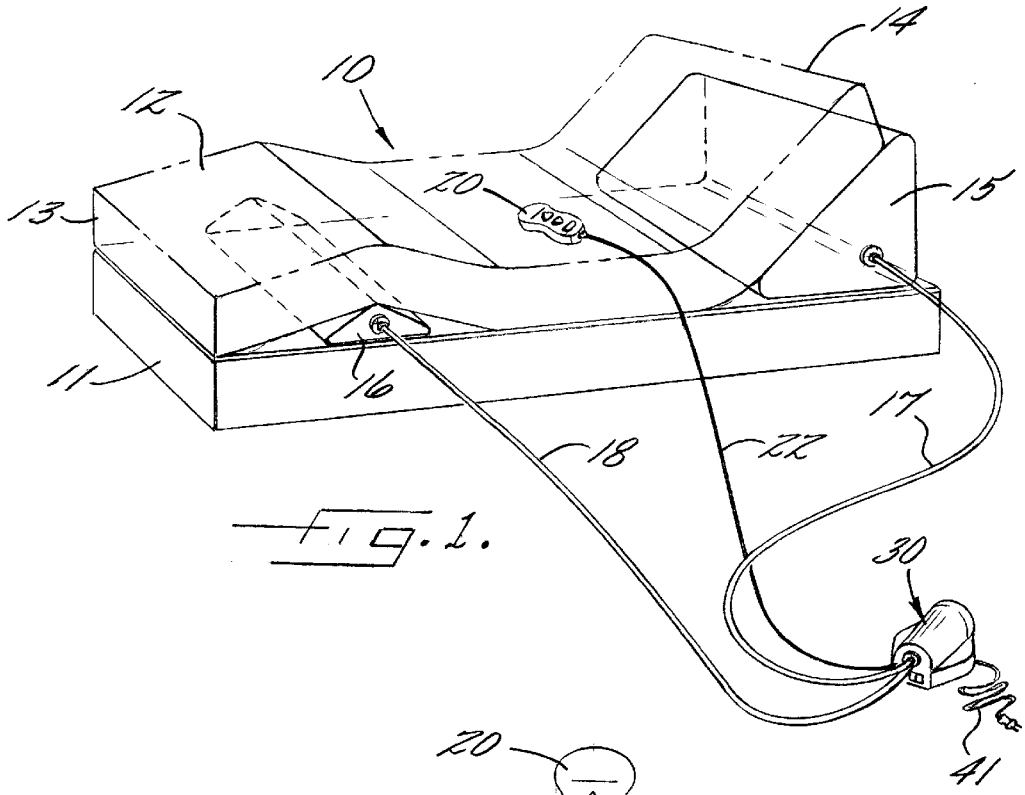
Figure 2:
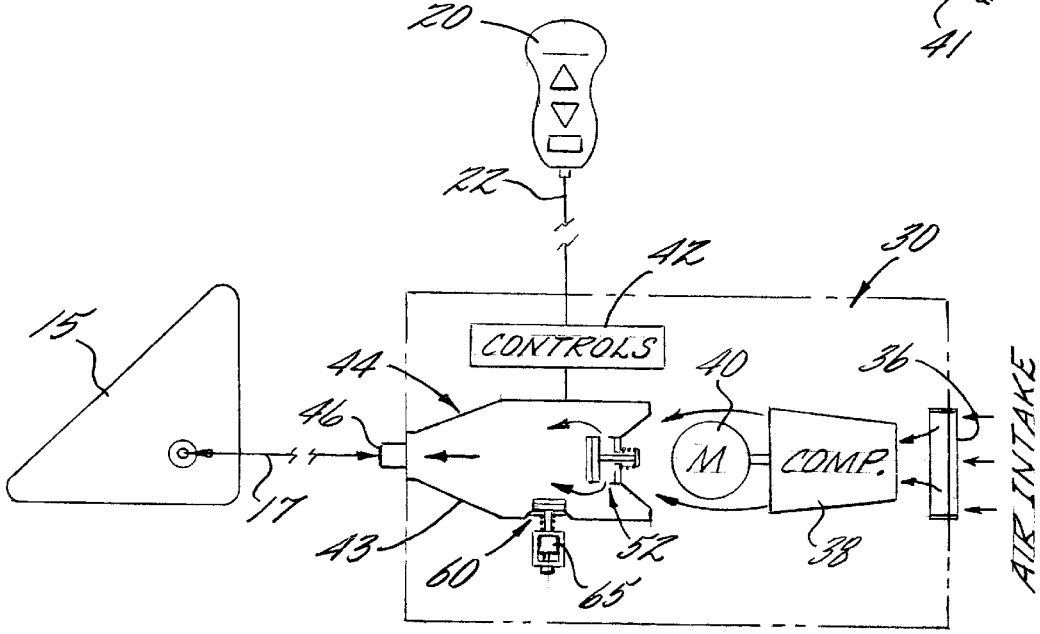
Figure 3:
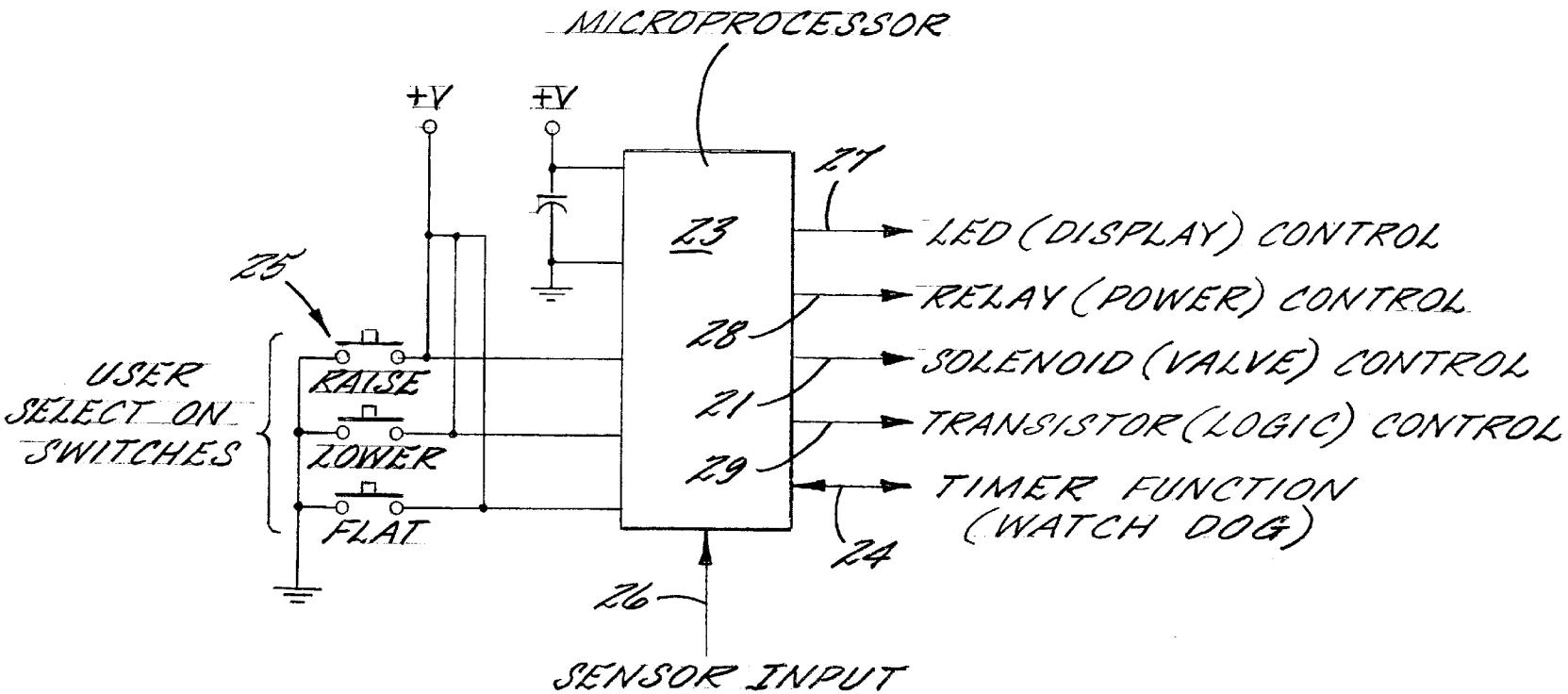
Figure 4:
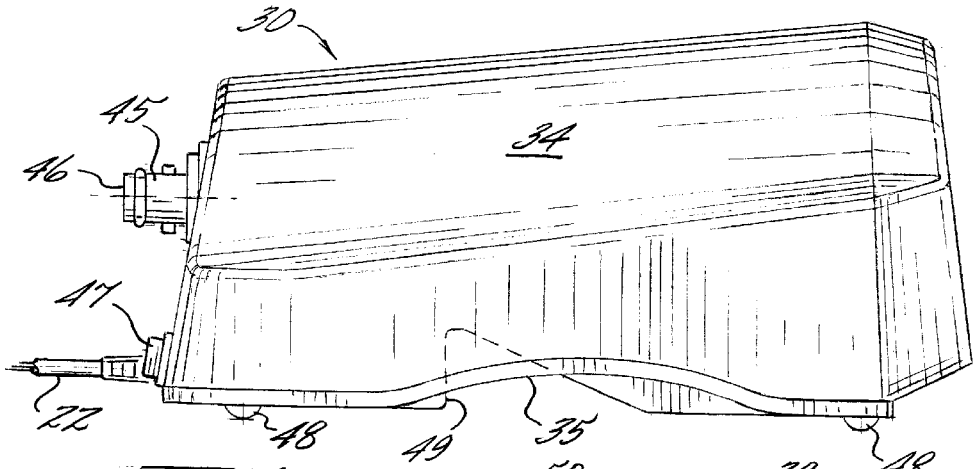
Figure 5:
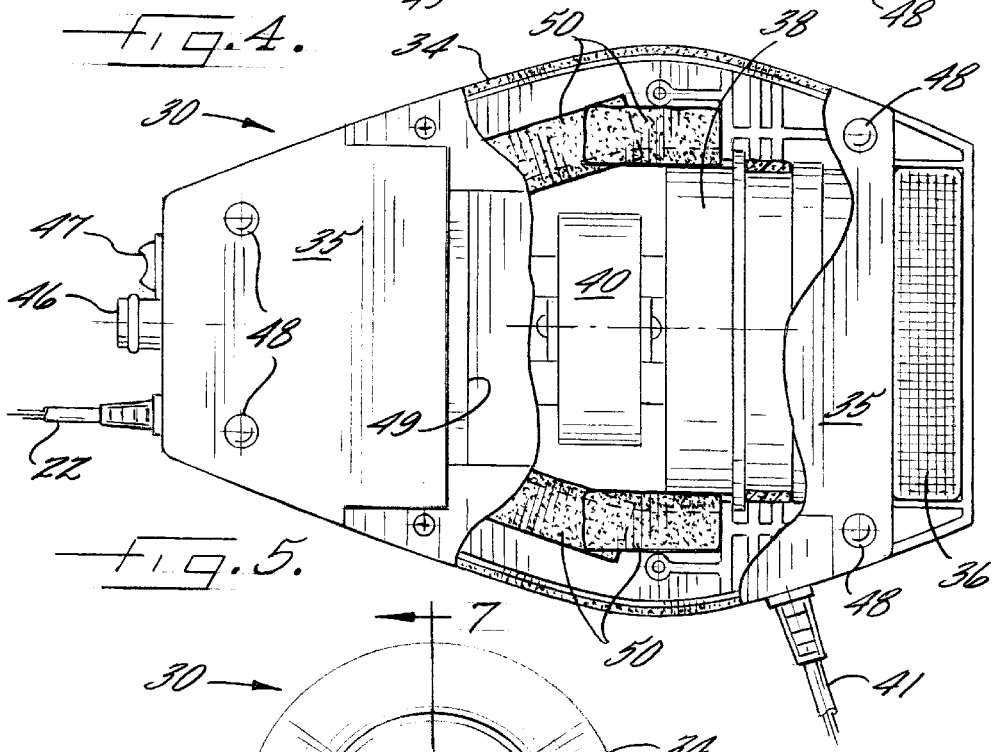
Figure 6:
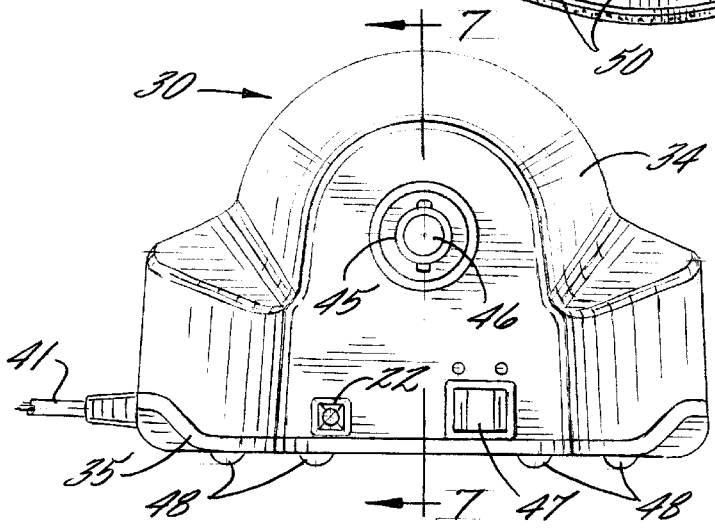
Figures 7, 8:
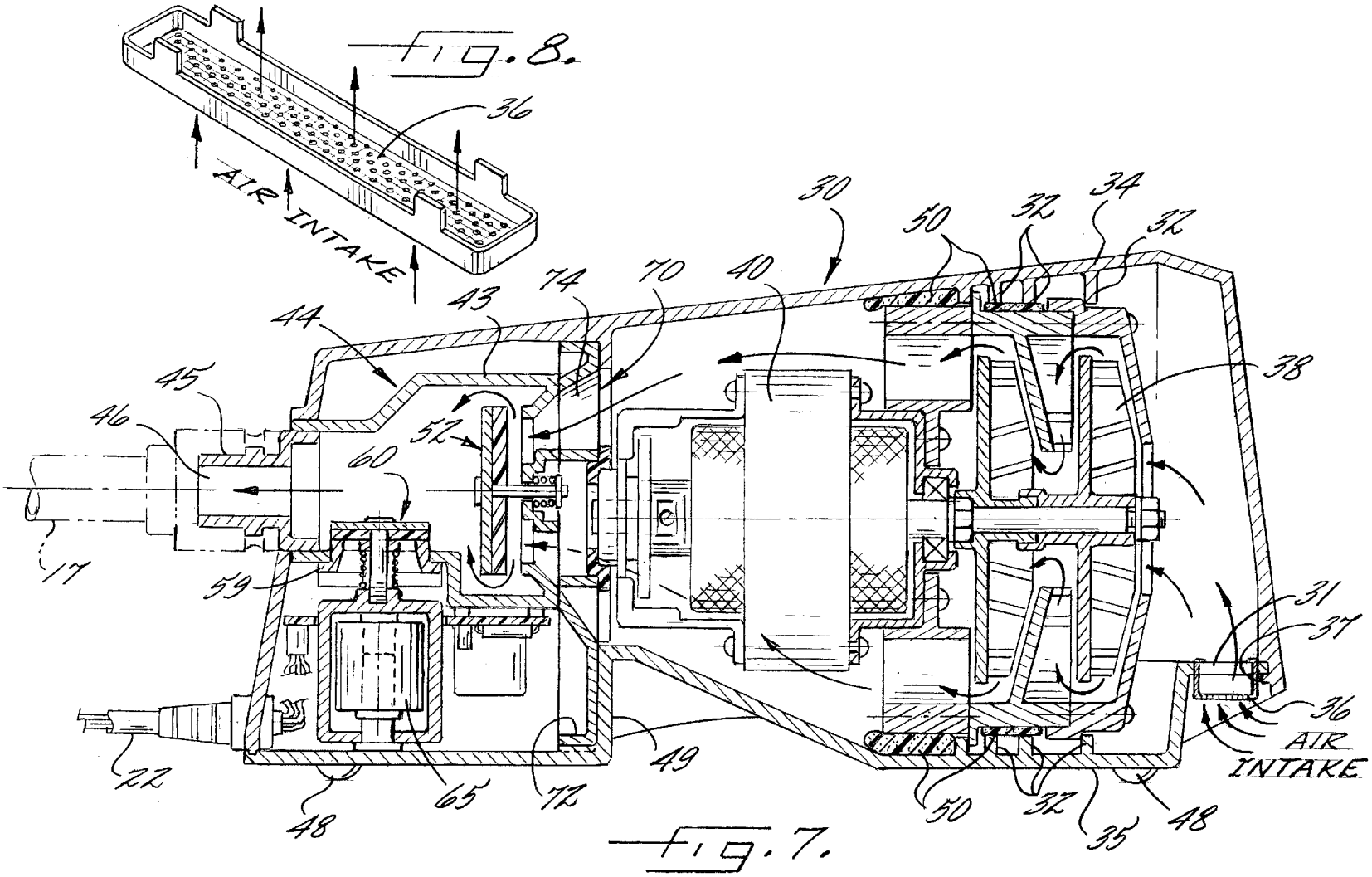
Figure 9:
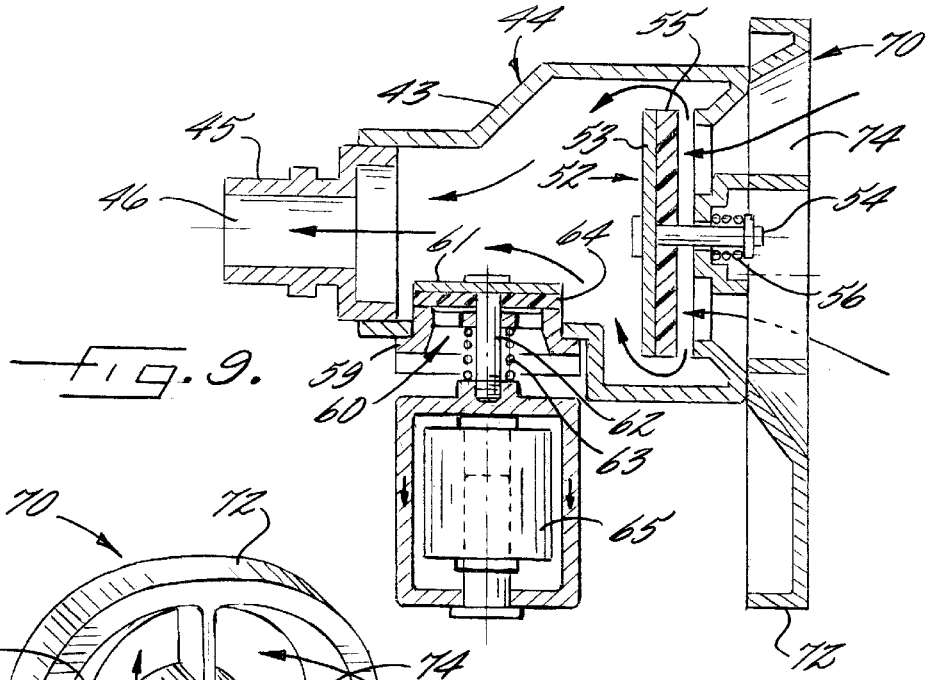
Figure 10:
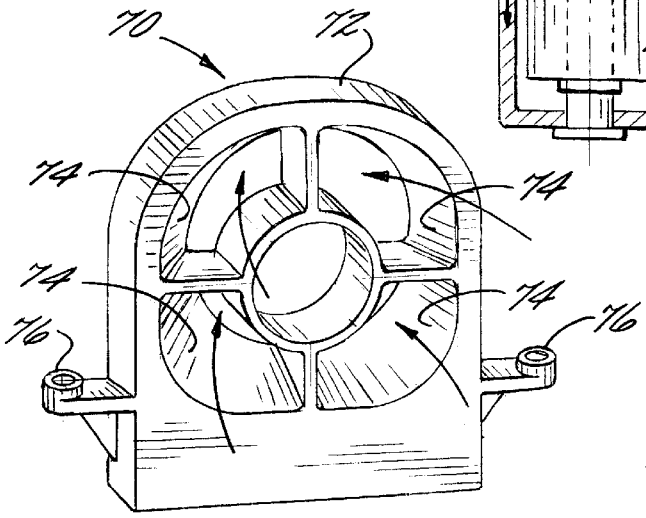
Figure 11:
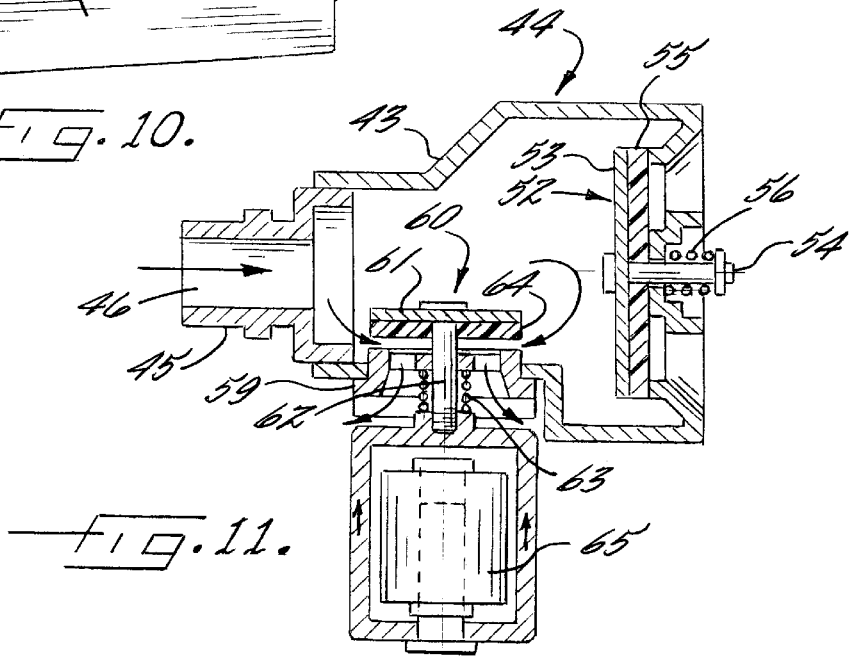
Figure 12:
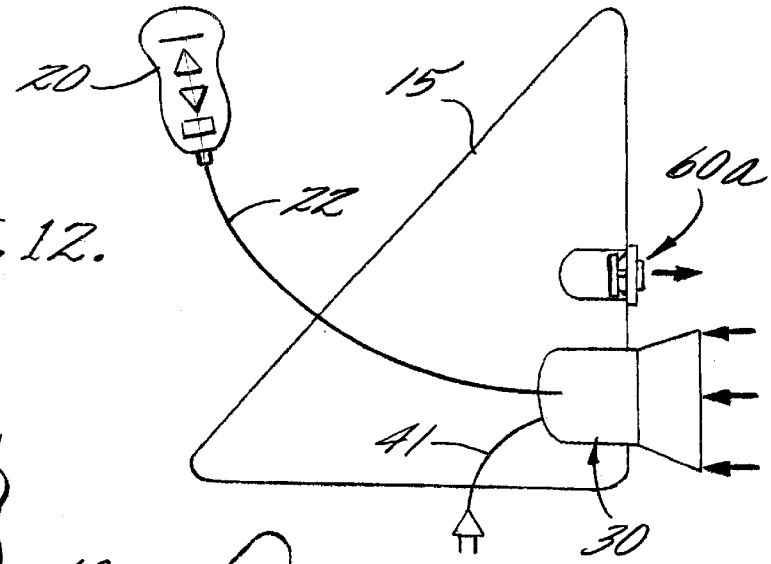
Figure 13:
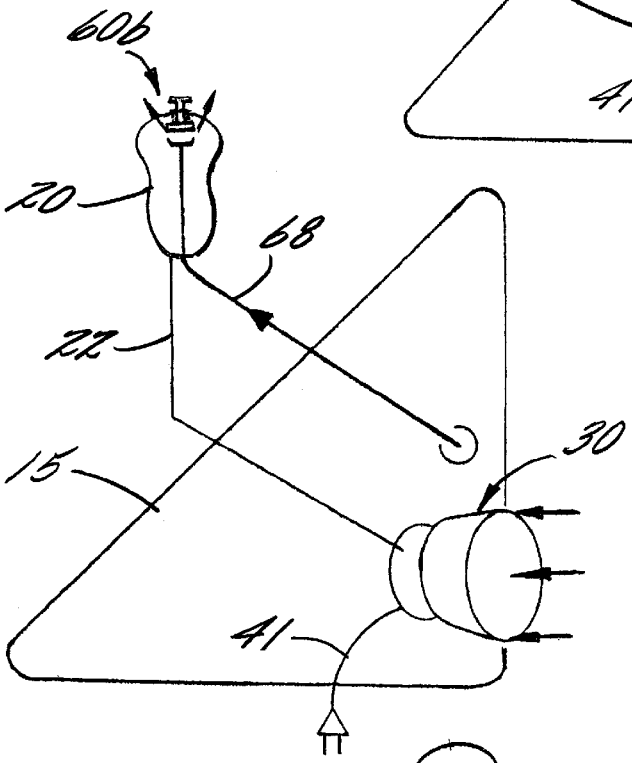
Figure 14:
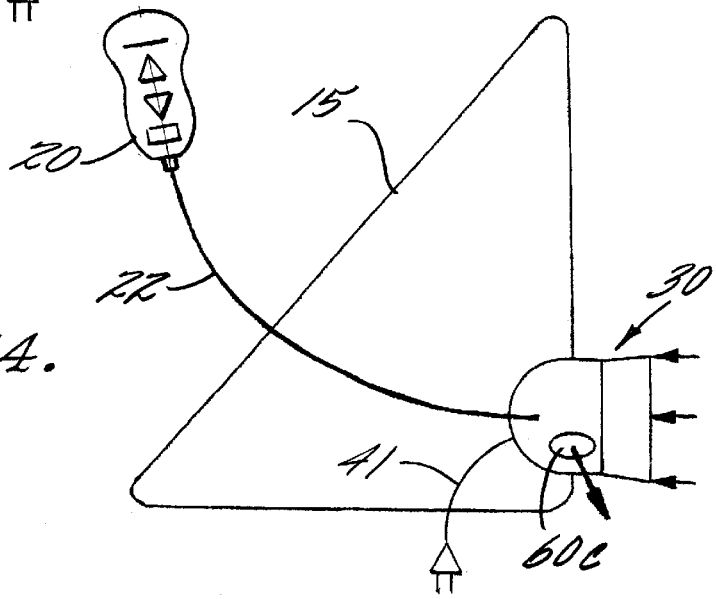
Figure 15:
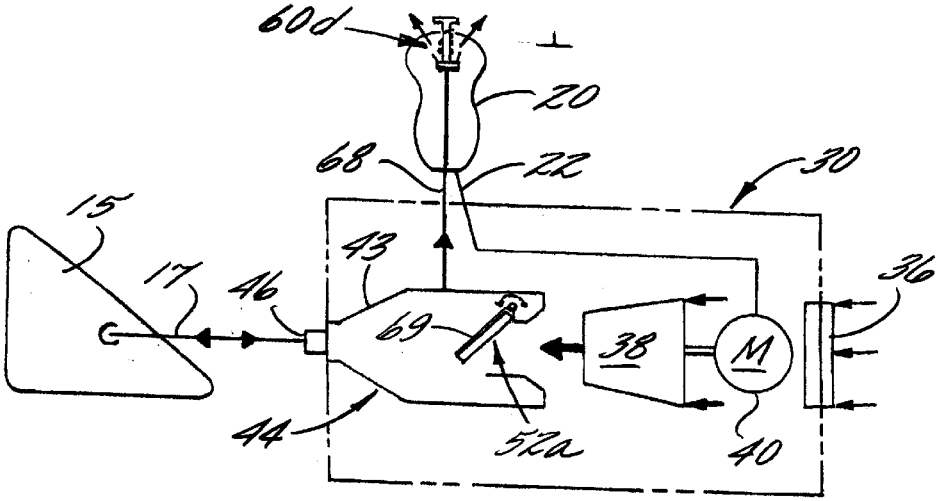
Figure 16:
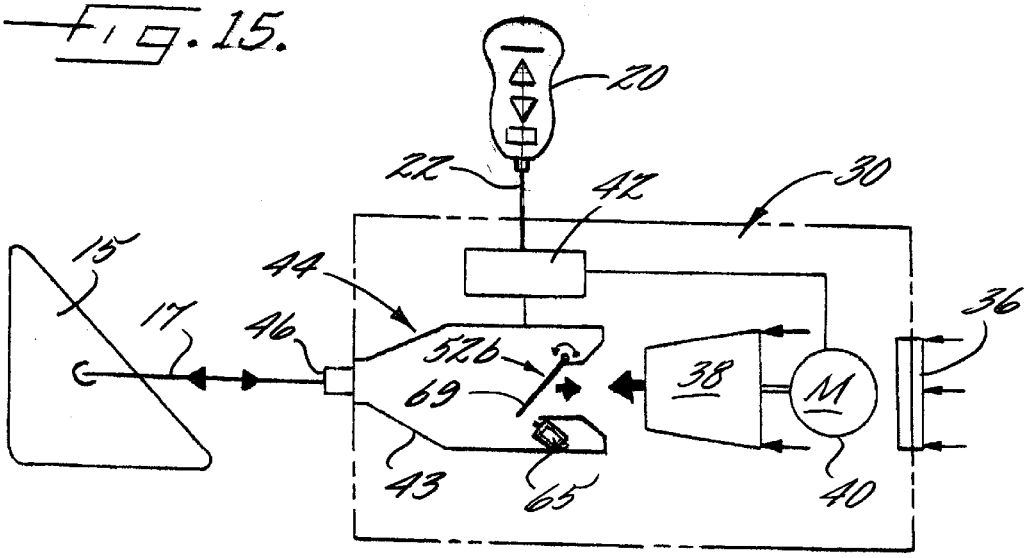
Figure 17:
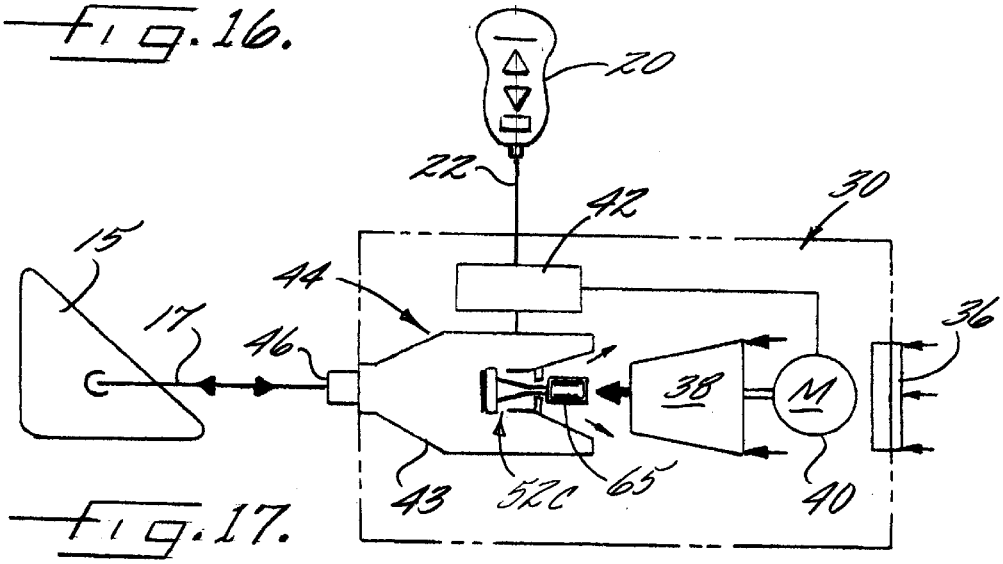
Figure 18:
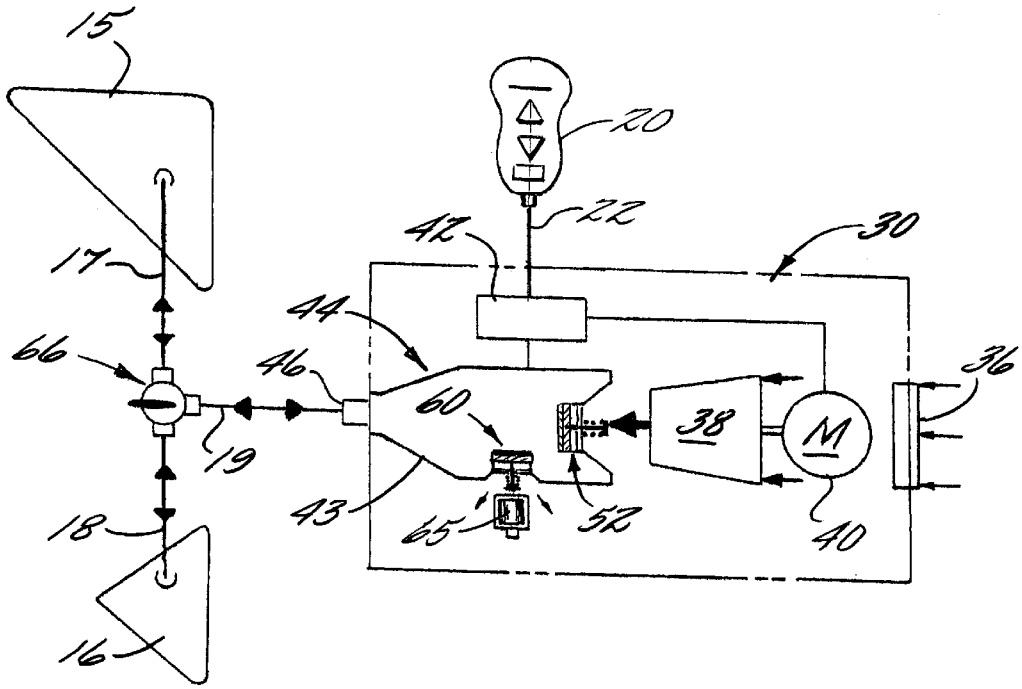
Figure 19:
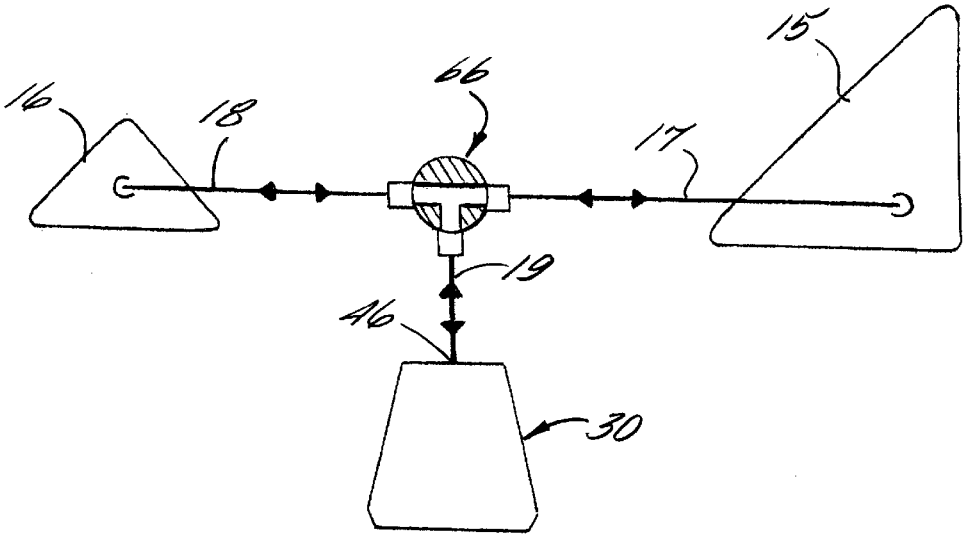
Figure 20A:
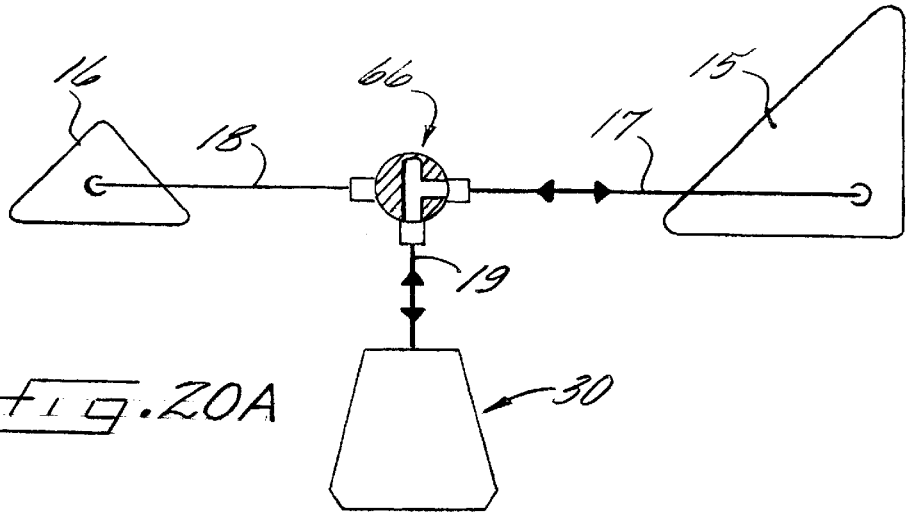
Figure 20B:
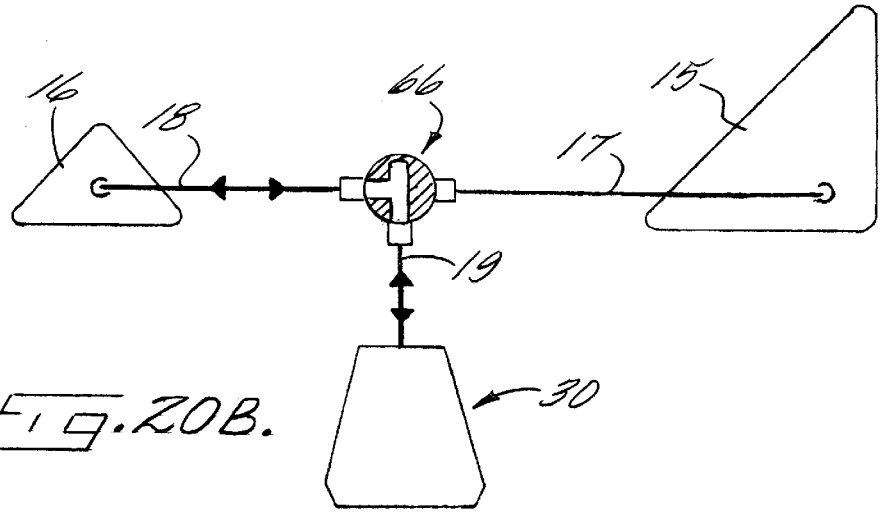
Figure 20C:
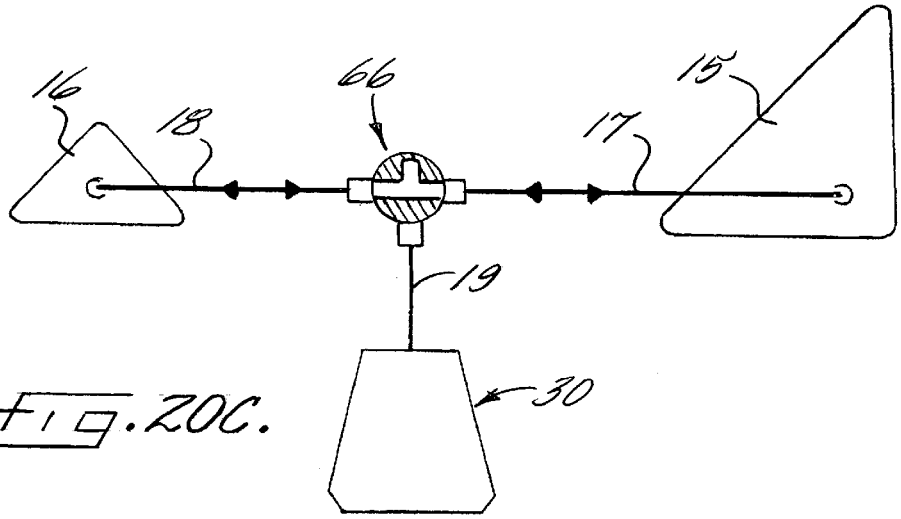
Figure 21:
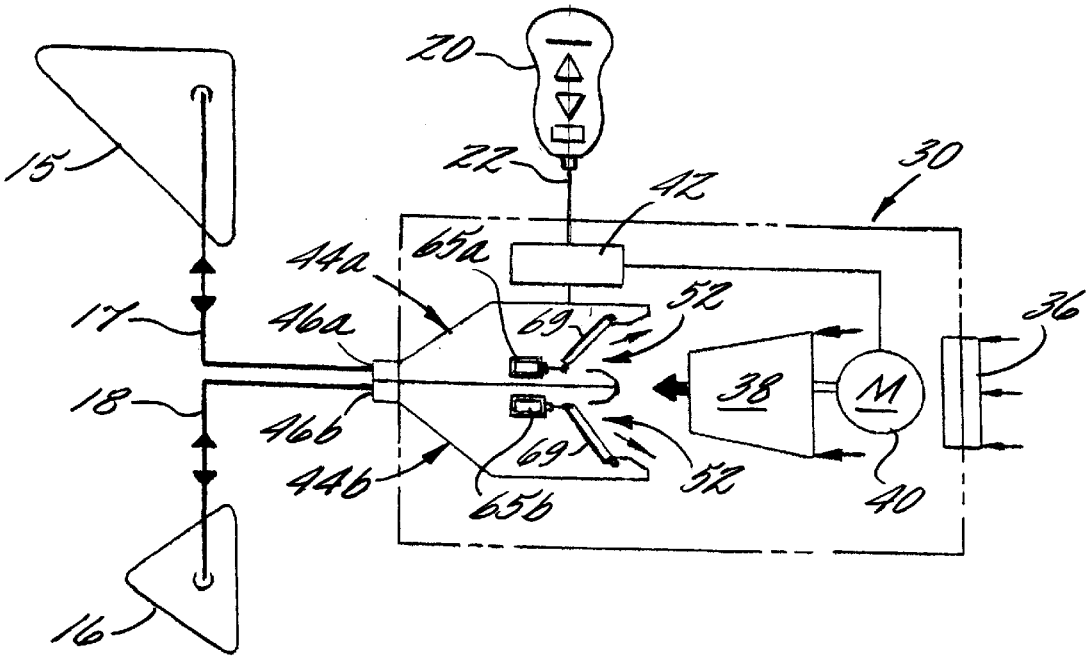
Figure 22:
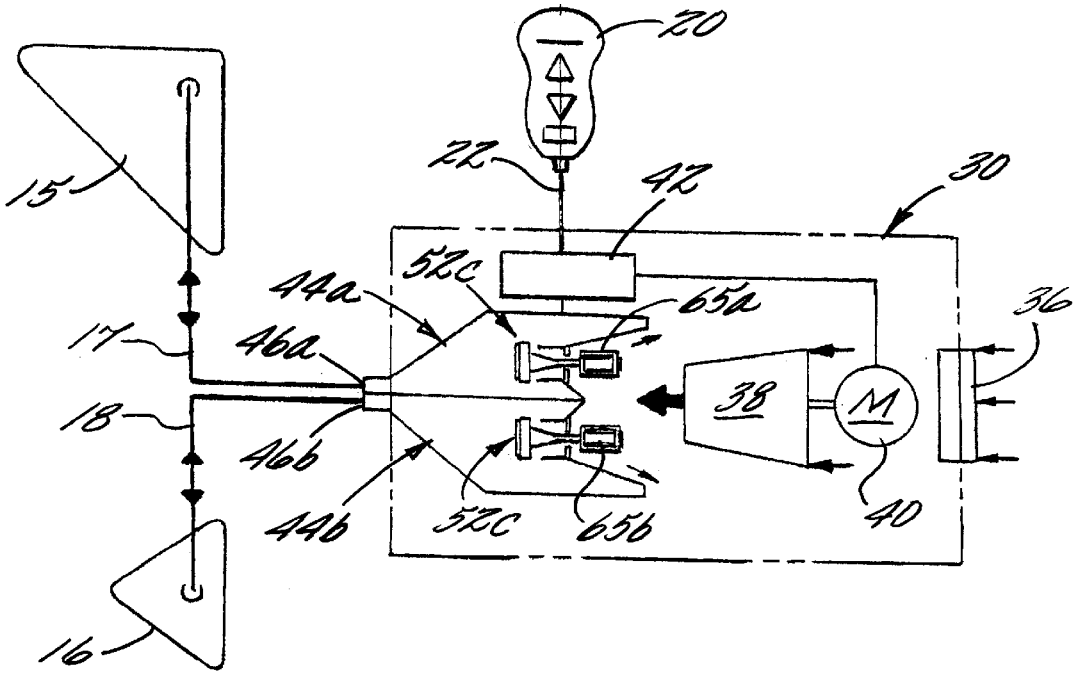

Having thus described the invention in general terms, reference will now be made to the accompanying drawings, which are not necessarily drawn to scale, and wherein:

FIG. 1 illustrates an adjustable bed according to the present invention showing a bladder at the head of the bed and a bladder toward the foot of the bed both in an elevated position, a compressor assembly for inflating and deflating the bladders and a controller for controlling the actions of the compressor assembly;

FIG. 2 is a schematic diagram showing an embodiment of the components of the present invention showing the bladder, the compressor assembly and the controller in an inflation mode;

FIG. 3 is a schematic diagram of inputs and outputs of a microprocessor used to control the compressor assembly of the present invention;

FIG. 4 is a side view of the compressor assembly of the present invention;

FIG. 5 is a bottom view of the compressor assembly of this invention having a portion of the housing bottom removed;

FIG. 6 is a front view of the compressor assembly shown in FIG. 4 of this invention showing the air outlet and air hose connector;

FIG. 7 is a cross-sectional view of the compressor assembly taken along line 7—7 of FIG. 6;

FIG. 8 is a perspective view of the air intake screen;

FIG. 9 shows a cross-sectional view of the valve assembly portion of FIG. 7 in inflation mode beginning with the compressor output air being moved through the largest cross-sectional turbine area and showing the solenoid operated relief valve in closed position and the check valve in open position;

FIG. 10 illustrates the multiple fin support frame for transitioning air into the valve assembly;

FIG. 11 shows a cross-sectional view of the valve assembly of FIG. 9 in deflation mode having the relief valve in open position and the check valve in closed position;

FIG. 12 illustrates a schematic sketch of the components of the present invention in an embodiment wherein the relief valve is placed directly in the bladder;

FIG. 13 illustrates a schematic sketch of the components of the present invention in an embodiment wherein the relief valve is positioned in the controller and connected to the bladder;

FIG. 14 illustrates a schematic sketch of the components of the present invention in an embodiment similar to that of FIG. 2 wherein the relief valve is positioned in the compressor housing;

FIG. 15 illustrates an embodiment of the present invention wherein the intake air passes into the valve assembly through a swing lock-type check valve to supply air to the bladder and the relief valve is manually operated;

FIG. 16 shows the embodiment of FIG. 2 except this embodiment utilizes a solenoid only for the purposes of opening the combination swing lock-type valve for exhausting air from the bladder;

FIG. 17 shows an embodiment similar that that shown in FIG. 2 except that the check valve is electronically controlled via an electronic solenoid coupled to the relief valve piston;

FIG. 18 illustrates an embodiment similar to that of FIG. 2 providing air to the bladders through a T-valve with the compressor assembly in the deflation mode;

FIG. 19 shows T-valve connected to an air line to the compressor assembly and to both a head bladder and a foot bladder;

FIG. 20A shows a first operating position for the T-valve open only to the head bladder;

FIG. 20B shows a second operating position for the T-valve open only to the leg bladder;

FIG. 20C shows a third operating position for the T-valve which is the same as that of FIG. 19 showing the T-valve open to both the leg and head bladders;

FIG. 21 shows an alternative embodiment of the system of the present invention showing bladders at both the head and feet of the bed, a pair of air supply lines connecting the bladders to a two sectioned valve assembly and a controller for controlling the actions of the compressor; and FIG. 22 shows another alternative embodiment of the system of the present invention showing bladders at both the head and feet of the bed, a pair of air supply lines connecting the bladders to a two sectioned valve assembly and a controller for controlling the actions of the compressor.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring more particularly to the drawings, FIG. 1 shows a generally rectangular bed 10 having box springs or other suitable foundation 11, and a mattress 12. In other words, the bed used with the present invention may be a conventional bed. The mattress 12 has a head/back portion 14 and a leg/foot portion 13. There is provided an inflatable bladder 15 having an air supply tube 17 for inflating and deflating the bladder for raising and lowering the head portion 15 of the mattress. As shown in FIG. 1 there is also provided an inflatable bladder 16 having an air supply tube 18 placed under the knees of the user. It should be understood that bladder 16 may also be shaped to be placed under the foot portion of the mattress. The air supply tubes are connected to a compressor assembly 30 that is controlled by controller 20. As shown in FIG. 1 there are separate air supply tubes for each of bladders 15 and 16 but it should be understood that the air supply tubes 17 and 18 may be joined at a T-valve as shown in FIG. 19 with one tube from the T-valve 66 to the compressor assembly 30.

As shown in the preferred embodiment of FIG. 1, the bladder 15, when inflated, is a triangular shaped structure made of any flexible air-tight polymeric material. A number of such materials are known in the prior art, such as those materials typically used in the construction of swimming pool toys. The dimensions of the inflatable bladders may vary depending upon the size of the mattress intended to be elevated. Preferably, however, the inflatable bladders are of a width approximate that of the mattress. In addition to providing a unique head bladder 15, the present invention as shown in FIG. 2, also provides a system for manipulating the inflation and deflation of the bladder 15 or bladders 15 and 16. As will be seen in FIG. 18, there is shown the embodiment of FIG. 2 in the deflation mode releasing air through T-valve 66 with the motor 40 in the "off" position and relief valve 60 open.

The present invention provides a microprocessor-based controller 20 whereby an individual can raise or lower the head area and/or knee area of the mattress 12 to any desired position with a simple hand held control. In addition, the controller 20 permits programming so that a portion of the mattress can be automatically raised and lowered to different levels during different periods of time. An additional feature is that the user does not need to simply continue to hold the switch down in order to raise or lower the bed position but instead, can press a simple button after the entire hand controlled microprocessor has been preprogrammed so that any one of a number of different adjustments can be made and these can be made at any given time and preset to any given time and interval.

As noted, the system of the present invention includes a bladder 15 or bladders 15 and 16, connected by an air supply hose 17 or hoses 17 and 18, respectively to compressor assembly 30 and controller 20. As shown in FIG. 2, the compressor assembly 30 includes an air intake screen 36, centrifugal blower 38, a motor 40, controls 42 and a valve assembly 44. When inflating, air passes through a check valve 52 into the valve assembly 44 and through air outlet 46 that is connected to a tube, such as air supply tube 17. In a preferred embodiment, the valve assembly 44 is equipped with a relief valve 60 controlled through solenoid 65.

In the embodiment shown in FIG. 1, the controller 20 is a hand held unit that includes an interface having various switches that allow the user to communicate through line 22 with the controls 42 in the compressor assembly 30 to inflate and deflate the bladder to thereby alter the position of the bed. Further, the interface of the controller 20 includes various indicators such as LED indicators and/or LCD displays that provide information to the user concerning the position of the bed and the control of the motor 40. With reference to FIG. 3, the controller 20 includes a microprocessor 23. The microprocessor has inputs connected to the selector switches 25 and an input 26 connected to a pressure sensor associated with the bladders 15 and/or 16. The microprocessor 23 also includes various outputs. For example, an indicator output 27 provides display information to the LED indicators and/or LCD displays of the hand held controller 20. Further, the microprocessor 23 includes an output 28 to control the relay of the motor 40 to thereby control the on and off condition of the motor 40. The microprocessor 23 includes an output 21 to control the release valve and logic control 29 for controlling the function of the motor 40. Importantly, associated with the microprocessor 23 is computer software, such as machine code, or control logic for dictating the operation of the motor 40. Based on this software or logic and the selections made by the user via the switches 25, the microprocessor 23 controls the motor 40 to inflate and deflate the bladders so as to provide a desired position for the bed.

An important concern with inflation of the bladders 15 and 16 is that the user may over fill and thus, possibly damage the bladders. As such, in some embodiments, the microprocessor 23 further includes a maximum threshold value stored in memory. In this embodiment, during an inflation process, the microprocessor periodically samples the input from the pressure sensor and compares this value to the stored threshold value. Once the pressure in the bladder equals the threshold value, the microprocessor shuts off the motor 40, thereby preventing overfill of the bladders. There is a watchdog timer 24 to further insure that there is no possibility of the program going into an unknown state. The watchdog timer 24 is a part of the microprocessor 23 that is enabled by software and monitors the normal program operation. If the program differs from its normal function the watchdog timer will be activated and the microprocessor 23 will be reset and will re-start into its normal program. This will insure that the system will tolerate power line noise and other abnormalities.

A side view of the compressor assembly 30 is shown in FIG. 4 and a front view of the compressor assembly 30 is shown in FIG. 6. The compressor assembly 30 has a rather wide footprint and is somewhat triangulated to provide stability and decrease the cross-sectional area of the assembly as the air passes through. An advantage of this design is that the compressor assembly 30 has a low profile so that it to be placed under a bed. As shown in FIG. 4, the compressor assembly 30 includes a compressor housing cover 34 and an interconnecting housing bottom 35. As shown more clearly in FIG. 7, the inside of the compressor assembly 30 forms a first chamber containing, among other things, a centrifugal blower 38, an electrical motor 40. A valve assembly 44 forms a second chamber. Power cord 41 extends through the side of compressor housing cover 34. The power cord 41 connects the compressor motor 40 to the house current. A transformer (not shown) may be used to step down the household current. An air outlet opening 46, having fitting, such as a nipple fitting 45, for attaching the air supply hose that extends through the front of the controller housing cover 34 and connects to the chamber of the valve assembly 44. Also extending through the controller assembly housing cover 34 is controller signal line 22. There is also provided a switch 47 for turning the motor 40 on or off. The switch may also have a high and low speed level. The switch 47 is usually left in the "on" position. The compressor assembly housing cover 34 and housing bottom 35 may be made of a suitable plastic. The thickness of the plastic housing cover and bottom are made in maximum practical molding thickness for noise reduction. The housing bottom 35 may have a recessed cavity 49 that is useful as a handhold in picking up the compressor assembly.

FIG. 5 illustrates a partial cut away of a bottom view of the compressor assembly 30. As shown, the housing bottom 35 is attached to the housing cover 34 by screws. Rubber feet 48 are placed on the housing bottom 35 to absorb energy and lessen vibration noise. As noted, one of the advantages of the system of the present invention is that it is extremely quiet. To obtain the desired quietness, inside the compressor assembly housing 30 there is a perimeter of sound reducing material 50 placed around the interior of the housing cover to minimize noise that is created.

The compressor assembly housing bottom 35 shown in FIG. 7 has an opening 31 at the rear with means 37 for retaining the air intake screen 36 to the housing bottom. The housing bottom 35 includes upstanding molded ribs 32 for supporting the electric motor 40 and centrifugal blower 38 in a stationary position within the compressor assembly 30. The housing cover 34 also includes molded ribs 32 that are complementary to the upstanding molded ribs of housing bottom 35. When activated, air is drawn through air intake screen 36 to develop a positive pressure in the housing. The volume of air is reduced as the air moves from a first chamber (comprising the rear portion of the compressor assembly) through the air volume reduction funnel 70 into a second stage that is represented by smaller chamber shown as valve assembly 44. The air volume reduction funnel 70 is illustrated more clearly in FIG. 10. The air volume reduction funnel 70 is a frame 72 that has multiple fins/supports 74 to direct and reduce the volume of air entering the second chamber. The funnel 70 is attached to the housing bottom 35 at attachment arms 76. When powered, air enters the through the air intake screen 36, and is directed through the first chamber past the centrifugal blower blades 38, around the motor 40 through the air reduction funnel 70 into the valve assembly 44 that forms a second chamber. As shown in FIG. 8, air intake screen 36 may be designed to snap fit retaining means 37 into the rear of the bottom housing 35 and is designed to reduce the noise from the incoming air. When the motor 40 is activated the positive air pressure opens check valve 52 to allow the air to pass through the smaller second chamber 44 and through the air outlet opening 46.

In addition, the valve assembly 44 also includes a relief valve 60 operated by a solenoid 65 in communication with the controller 20. When opened, the relief valve 60 releases air from the bladders to the atmosphere, thereby deflating the bladders.

FIG. 9 shows a cross-section of the valve assembly 44 shown in FIG. 7 in inflation mode. The valve assembly housing 43 has a valve 52 secured to the end of the housing 43 abutting the air volume reduction funnel 70 and an air outlet 46 at the other end of the housing. It will be understood by those skilled in the art that the valve 52 may be a check valve, a gate valve, an umbrella check valve or such other type valve that prevents air from returning to the first chamber. A relief valve 60, operated by solenoid 65, is positioned at the bottom of the housing 43. The relief valve 60 may be a check-type valve. The valve 52 includes a rigid plate 53 having a rod 54 therethrough. The rigid plate 53 has a soft polymeric material 55 affixed to the side facing incoming air to form a seal with the housing 43. One end of rod 54 is affixed to plate 53. At the other end of rod 54 is a spring 56 that serves to keep the check valve closed when motor 40 is off. The relief valve 60, like the check valve, has a rigid plate 61 having a rod 62 therethrough. The rigid plate 61 has a soft polymeric material 64 affixed to the underside of the plate 61 to form a seal with the valve seat 59. At the outer end of rod 62 is a spring 63 that serves to keep the relief valve 60 closed when the motor 40 is "on". In operation, compressed air passes through the openings formed by the multiple fins/supports 74 of the air reduction funnel 70 exerting sufficient pressure on rigid plate 53 to overcome the resistance of spring 56 and thereby open the valve 52 allowing air to pass into the second chamber and through air outlet 46. In this mode of operation, relief valve 60 is in a closed position.

FIG. 11 shows a cross-sectional view of the valve assembly 44 in deflation mode. The valve assembly 44 has the relief valve 60 in open position and the valve 52 in closed position. Because of the high energy requirements needed to open the air release door of relief valve 60 under normal operating pressure, there exists a need to drive the solenoid 65 with a high current during the initial opening of the door and to reduce the drive current to hold the door open. If the high current drive remained on during the 7 minute operating time the solenoid 65 would become hot. Since the solenoid 65 is driven by a transistor powered from the microprocessor 23, one of the outputs of the microprocessor 23 is driven as a pulse width modulated signal. The beginning of the drive signal would be, as an example, a continuous drive for 100 mSec. This signal is followed by a drive signal of 5 mSec., then one followed by 15 mSec., and off for the duration of the holding time. A large storage capacitor (not shown) is placed in the power supply to provide the necessary energy to energize the solenoid 65 for the initial 100 mSec. drive. The value of the storage capacitor is much larger than would be required if this high energy were not required.

FIG. 12 illustrates a schematic sketch of another embodiment of the system of the present invention. There is shown an inflatable bladder 15 connected to compressor assembly 30 (connection is not shown). The compressor assembly is connected to controller 20 through controller signal line 22. There is provided a relief valve 60*a* coupled directly to bladder 15. The relief valve 60*a* is manually operated via depressing same. FIG. 13 presents a somewhat different schematic sketch of the components of the system of the present invention. The bladder 15, the compressor assembly 30 and controller 20 are all similar components except the controller 20 has been adapted to contain the relief valve 60*b*. The relief valve 60*b* is positioned in the controller 20 and connected to the bladder via exhaust tubing 68. Air is exhausted via depressing the manually operated relief valve. Exhaust tubing is attached to the bladder 15 and connects to the relief valve. In a third embodiment, that shown in FIG. 14 there is a schematic sketch of the components of the present invention wherein the relief valve 60*c* is a manually operated valve positioned in the compressor assembly 30.

FIGS. 15–17 show various valve arrangements that may be used in the system of this invention. In FIG. 15 there is illustrated an embodiment of the present invention wherein there is shown a bladder 15 connected by an air supply tube 17 to compressor assembly 30. The compressor assembly 30 is connected to controller 20 via signal line 22. There is provided a manually operated relief (deflation) valve 60*d* coupled directly to controller 20. While this embodiment is similar to that of FIG. 2, the differences are significant in that the intake air passes into the valve assembly 44 through a swing lock-type valve 52*a* to supply air to the bladder 15. The compressed air forces open swing door 69 to supply air to the bladder via flexible tubing 17. Exhaust tubing 68 is connected through valve assembly housing 43 that integrates outlet air to the bladder 15 and terminates at remote, manually operated relief valve 60*d* in controller 20. Swing lock-type valve 52*a* is spring loaded to assist in sealing against bladder leakage under very low pressure conditions. Swing door 69 has soft polymeric material fixed to contact valve land surface when closed.

FIG. 16 illustrates shows an embodiment of the present invention similar to that of FIG. 2 except the embodiment FIG. 16 utilizes a solenoid only for the purpose of opening the combination swing lock-type valve 52*b* for exhaust air from the bladder 15 to allow the air to flow backwards through the compressor assembly 30 and out through the air intake 36. The compressor assembly 30 is connected to controller 20. The combination check valve/relief valve 52*b* does not need to be permanently fixed to the swing lock-type valve door, but it could be. This door will close by use of spring force, gravity and/or return air pressure from bladder 15. The controller 20 turns on the motor 40, as well as operating the solenoid 65 in one direction only (in the case of no permanent attachment to the swing door) or in two directions, in the case of permanent attachment to the door.

FIG. 17 shows another embodiment similar that that shown in FIG. 16 except that the check valve/relief valve 52*c* is electronically controlled via solenoid 65 coupled to the valve piston. In this embodiment, there is shown a head bladder 15 connected by air supply line 17 to compressor assembly 30. The compressor assembly 30 is connected to controller 20. When the compressor is powered "on", the combination check valve/relief valve 52*c* is powered concurrently and directly opens the valve piston so that air the second chamber whereby it passed through to bladder 15. The combination check valve/relief valve 52*c* is immediately powered again to return to the closed position upon release of the compressor on key. When air is required to be exhausted, the solenoid 65 is controlled by a deflation key, whereby it opens the combination valve 52*c* for either the period of time the key is depressed, or for a period of time controlled by the microprocessor when the "flat" key is utilized (if this feature exists).

There is shown in FIG. 19 a T-valve 66 connecting an air line 19 to the air outlet opening 46 in the compressor assembly 30. The T-valve 66 connects the air hose 19 to both the head bladder 15 and the leg bladder 16 via air hoses 17, 18, respectively. FIGS. 20A–20C shown the various operating positions of the T-valve 66. In the first operating position shown in FIG. 20C the T-valve 66 is open to both head bladder 15 and leg bladder 16 thereby filling both bladders simultaneously. In the operating example shown in FIG. 20A the T-valve 66 in the air supply line 19 is open to inflate only the head bladder 15. Lastly, in the operating example shown in FIG. 20B the T-valve 66 in the air supply line 19 is open to inflate only the leg bladder 16 through air supply line 18.

An alternative embodiment of air delivery to the bladders is shown in FIG. 21 wherein bladders 16 and 17 at the head and feet of the bed are provided. Air is supplied to the bladders by a pair of air supply lines 17 and 18 connecting the bladders to a twin sectioned valve assembly 44*a* and 44*b*. A controller 20 controls the actions of the motor 40. The two-sectioned valve assembly 44*a* and 44*b* are designed similar, component wise, to the embodiment shown in FIG. 16. More specifically, there is provided a compressor assembly 30 connected to the controller 20. The controller turns on the motor 40, as well as operating solenoids 65*a* and 65*b*. In this embodiment, one side of the compressor assembly 30 provides air in a predetermined amount to bladder 15 through line 17. The other portion of valve chamber 44*b* is used to provide air to inflate leg bladder 16 through line 18.

FIG. 22 shows another alternative embodiment of the system of the present invention showing bladders 15 and 16 at both the head and feet of the bed, a pair of air supply lines 17 and 18 connecting the bladders to a twin sectioned valve assembly 44*a* and 44*b* and a controller 20 for controlling the actions of the motor 40. The embodiment shown in FIG. 22 most closely resembles the single valve chamber shown in FIG. 17 in terms of using a combination of check valve/relief valve. In FIG. 22 the portion of valve chamber designated 44*a* includes combination valve 52*c* activated and deactivated by solenoids 65*a*. The other portion of the valve assembly 44*b* supplies air through tube 18 to the foot bladder 16. This portion of valve assembly 44*b* uses a combination valve 52*c* activated by solenoid 65*b*.

As with many conventional adjustable bedrest, the present invention allows the user to manually a select position the portion of the bed to be raised or lowered. Specifically, by depressing and holding down the selector switches of controller 20, a user controls the position of the bed. For example, if the user wishes to raise the mattress, the user can depress and hold the "up" button on controller 20. In this instance, the microprocessor 23 will receive this input and will control the motor 40 to fill the bladder. The microprocessor 23 will periodically sample the input and will continue to fill the bladder until the user has released the button. Similarly, if the user depresses the "down" button on the controller 20, the microprocessor 23 controls the release valve 60 to open, and allows the bladder to deflate until the button is no longer depressed. In some embodiments, for example that of FIG. 17, during deflation, the microprocessor 23 may also control the motor 40 to expel air from the bladder 15 to aid in deflation.

In yet another embodiment, the microprocessor 23 includes in addition to the over fill time threshold value, a current time value representing the time duration of inflation from an empty bladder state to the current position of the bed. In other words, if the bladder is completely empty, the current time value is zero, but if the bed is at a first position, the stored current time value equals to the time duration to inflate the bladder to the current position. In this embodiment, if the user controls the microprocessor 23 to further inflate the bladder, the microprocessor counts the time that the bladder is being inflated and adds it to the stored current time value. This total value is then compared to the threshold value to ensure that the bladder is not over filled.

As mentioned previously, one problem noted with many conventional adjustable bed rest systems is that the user must continually depress the selector switch until the bladder has been inflated or deflated to place the bed in a desired position. The present invention, however, remedies this problem in several ways. Specifically, the microprocessor 23 of the present invention, using the computer software or logic, may be controlled to inflate and deflate the bladder by merely short duration depressions of the selector buttons on the interface of the controller 20.

For example, in some embodiments, the user may control the microprocessor 23 to fill or deflate the bladder to a desired level by selecting, via the button, a preset position. In this embodiment, the microprocessor has stored in memory in table form different time durations for inflation of the bladders. Each time duration represents the amount time required for the motor to inflate the bladder to a desired pressure, which corresponds to a desired position of the bed. The microprocessor, either through a series of LEDS or a menu displayed on an LCD display, displays to the user the different possible positions. The user, via, the selector switches of the interface may choose a position for the bed.

For example, if the user selects to raise the bed position, the microprocessor, receives the input and retrieves from the table in memory the time duration associated with the selected position. The microprocessor 23 then controls the motor 40 to inflate the bladder. Further, the microprocessor also indicates to the user either by an LED or an LCD display that the bed is raising. The microprocessor, using an internal or external clock or counter, counts for the duration of time associated with the position selected by the user. At the end of the time duration, the microprocessor stops the motor, and displays on the LED or LCD display the new position of the bed.

If the user selects to lower the bed position, the microprocessor, receives the input and retrieves from the table in memory the time duration associated with the selected position. The microprocessor then controls the release valve to open, thereby deflating the bladder. Further, the processor also indicates to the user either by an LED or an LCD display that the bed is lowering. The processor, using an internal or external clock or counter, counts for the duration of time associated with the position selected by the user. At the end of the time duration, the processor closes the release valve, and displays on the LED or LCD display the new position of the bed.

In some embodiments, the bed may already be at a first position prior to a new selection by the user. In this embodiment, the microprocessor either has stored in memory the current position of the bed or determines the current position by reading the input from the pressure sensor. To alter the position of the bed, the microprocessor compensates the time duration associated with the new position based on the current position of the bed. For example, if the bed is at a first position and the user wishes to reposition the bed to a higher position, the microprocessor may subtract the time duration to raise the bed to the current position from the time for the microprocessor to raise the bed from a deflated position to the new selected position. The microprocessor then uses this calculated duration to control the motor to reposition the bed. A similar operation would be used to deflate the bed.

In an alternative manner, the microprocessor 23 could include stored incremental time duration values representing the time required to inflate or deflate the bladder and position the bed at different incremental positions. More specifically, the microprocessor could include in the stored table a first stored time duration for inflating the bladder to a first position. For the second position, the table would include the time duration for inflating the bladder from the first position to the second position, and so on for all subsequent positions. It would also include similar values for deflation. In this embodiment, if the bed is at a first position and the user requests that the bed be moved to a third higher position, the microprocessor would access the time durations for the second and third positions and inflate the bladder for the total time period. Further, if the user wishes to now move down to the second position, the microprocessor would access the memory and retrieve the time interval to deflate the bladder to the second position. It would then open the release valve for this time duration.

It is understood that the microprocessor 23 may either store a few positions or have several preset position levels. The time durations are typically stored in a look-up table and referenced by their corresponding position. Further, it is understood that the user may not have to use a display menu to select a position. The user could just transition through the different positions by pushing and releasing the up and down buttons. For example, if the user wished to raise the bed up two positions from its current level, they could push the up button on the hand held device twice. The microprocessor would receive the two inputs, access the time duration stored for raising the bed the two levels, and control the pump motor to fill the bladder for the total time duration.

The present invention also allows the user to select and store their own preset positions for the bed. In this embodiment, the user, via the buttons of the interface, places the microprocessor in a record mode. The user then controls the microprocessor to inflate or deflate the bladder to place the bed at a desired position. The user controls the microprocessor to store this position and indicates the position on the controller. Specifically, the when controlled, the microprocessor receives the pressure input from the pressure sensor and stores this value in memory. This value represents the pressure the bladder must be to place the bed in the desired position selected by the user.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for controlling an inflatable bladder for use in raising and lowering a portion of a mattress comprising:

at least one inflatable bladder having an air supply hose connected to a compressor assembly;

said compressor assembly comprising a first chamber having a blower and a motor, and a smaller second chamber having a valve assembly for allowing air to pass therethrough interconnected to said first chamber and an air outlet connected to said air supply hose; and a microprocessor in communication with said motor for controlling the operation of said motor, wherein said microprocessor includes a stored table containing a plurality of values each representing a value for inflation of the bladder to place the bed rest at a position.

2. The system according to claim 1 wherein said at least one inflatable bladder is a triangular shaped bladder when inflated.

3. The system according to claim 1 wherein said controller is a hand held controller.

4. The system according to claim 1 wherein said compressor assembly includes a check valve positioned in said second chamber between said first chamber and said second chamber.

5. The system according to claim 1 further comprising a multiple fin support frame positioned between said first chamber and said smaller second chamber for transitioning air into said second chamber.

6. The system according to claim 1 wherein a relief valve is placed directly in the bladder.

7. The system according to claim 1 wherein a relief valve is positioned in the controller and connected to said bladder.

8. The system according to claim 1 wherein a relief valve is positioned in said compressor housing.

9. The system according to claim 1 wherein compressed air passes into the valve assembly through a swing lock-type check valve to supply air to the bladder and a manually operated relief valve is provided.

10. The system according to claim 1 wherein a check valve/relief valve combination is electronically controlled via a solenoid.

11. The system according to claim 1 wherein there are two inflatable bladders and air to at least one of said bladders passes through a T-valve connected by an air hose to said bladders and to said compressor assembly.

12. The system according to claim 1 wherein there are two bladders one at the head and the other at the feet of the bed, a pair of air supply hoses connecting said bladders to a two sectioned valve assembly and a controller for controlling the actions of the compressor.

13. The system according to claim 1 wherein there are bladders at both the head and feet of the bed, a pair of air supply lines connecting the bladders to a two sectioned valve assembly having a combination check valve/relief valve and a controller for controlling the actions of the compressor.

14. The system according to claim 1 wherein said compressor assembly includes an umbrella valve positioned in said second chamber between said first chamber and said second chamber.

15. A system for controlling the position of an inflatable bedrest comprising;

a pair of inflatable bladders, each having an air supply hose connected to a compressor assembly;

said compressor assembly comprising a first chamber having an air intake, a centrifugal blower and a motor, and a smaller second chamber having a valve assembly interconnected to said first chamber and an air outlet connected to said air supply hose;

said valve assembly having a valve positioned in said second chamber between said first chamber and said second chamber for allowing compressed air to pass into the valve assembly and a relief valve;

a controller including a microprocessor in communication with said motor for controlling the operation of said motor, wherein said microprocessor includes a stored table containing a plurality of values each representing a value for inflation of the bladder to place the bed rest at a position; and an interface associated with said microprocessor having at least one selector for providing commands to said microprocessor, wherein a position for the bedrest can be selected by commanding said microprocessor to retrieve a stored value representing the selected position and said microprocessor controlling said motor to inflate said bladders based on the selected stored value to place the bed at the selected position.

16. The system according to claim 15 wherein said valve and said relief valve form a combination valve operated by a solenoid.

17. A compressor assembly for use with adjustable bedrest comprising:

a housing having a first chamber and a second chamber, said first chamber having an air intake, a centrifugal blower and a motor and said second chamber having a valve assembly interconnected to said first chamber and an air out connectable to an air supply hose;

said valve assembly having a valve positioned in said second chamber between said first chamber and said second chamber for allowing compressed air to pass into the valve assembly and a relief valve; and means for controlling the operation of said motor, wherein said means further includes a stored table containing a plurality of values each representing a value for inflation of the bladder to place the bed rest at a position.

18. The compressor assembly of claim 17 further comprising a multiple fin support frame positioned between said first chamber and said smaller second chamber for transitioning air into said second chamber.

19. The compressor assembly of claim 17 wherein said valve is a check valve.

20. The compressor assembly of claim 19, wherein said check valve is an umbrella valve.

21. The compressor assembly of claim 17, wherein said valve assembly further comprises a relief valve located within said second chamber wherein when the relief valve is open, air is exhausted outside of said compressor assembly.

22. The compressor assembly of claim 17, wherein said means includes a microprocessor in communication with said motor.

* * * * *